US005546064A

United States Patent [19]

Sallam et al.

[11] Patent Number: 5,546,064

[45] Date of Patent: Aug. 13, 1996

[54] SOLENOID WITH PLUNGER ROD

[75] Inventors: Faisal K. Sallam, Dearborn; Gilbert Gardocki, Dearborn Heights, both of Mich.

[73] Assignee: United Technologies Automotive, Inc., Dearborn, Mich.

[21] Appl. No.: 418,891

[22] Filed: Apr. 6, 1995

Related U.S. Application Data

[63] Continuation of Ser. No. 167,738, Dec. 19, 1993, abandoned.

[51] Int. Cl.[6] ..... H01F 3/00; H01F 7/12; H01F 7/10; H01F 7/08

[52] U.S. Cl. ..... 335/261; 335/249; 335/251; 335/255

[58] Field of Search ..... 335/249, 251, 335/252, 255, 261, 262, 263, 275, 276, 264, 258

[56] References Cited

U.S. PATENT DOCUMENTS

| | | | |
|---|---|---|---|
| 893,305 | 7/1908 | Cheney . | |
| 1,226,748 | 5/1917 | Burnham . | |
| 1,258,721 | 3/1918 | Tatum . | |
| 1,845,269 | 2/1932 | Heitman . | |
| 2,046,401 | 7/1936 | Moore . | |
| 2,112,054 | 3/1938 | Thumim . | |
| 2,262,061 | 11/1941 | Somers . | |
| 2,411,778 | 11/1946 | Wilde . | |
| 2,682,625 | 6/1954 | Soreng . | |
| 2,911,494 | 11/1959 | Rigert . | |
| 2,959,648 | 11/1960 | Williams . | |
| 3,510,814 | 5/1970 | Nordfors . | |
| 3,916,362 | 10/1975 | Schantz | 335/262 |
| 4,556,085 | 12/1985 | Warrick . | |
| 4,570,904 | 2/1986 | Mullally . | |
| 4,595,035 | 6/1986 | Warrick . | |
| 4,617,968 | 10/1986 | Hendrixon . | |
| 4,674,536 | 6/1987 | Warrick . | |
| 4,753,263 | 6/1988 | Warrick . | |
| 4,765,587 | 8/1988 | Cummins . | |
| 4,855,702 | 9/1989 | Swanson et al. . | |
| 4,863,142 | 5/1989 | Hendrixon et al. . | |
| 4,893,104 | 1/1990 | Donini | 335/266 |
| 5,146,196 | 9/1992 | Frank | 335/271 |
| 5,207,410 | 5/1993 | Wakeman . | |
| 5,238,224 | 5/1993 | Horsting . | |

FOREIGN PATENT DOCUMENTS

| | | |
|---|---|---|
| 0027404 | 4/1981 | European Pat. Off. . |
| 3938896 | 5/1991 | Germany . |
| 2145879 | 4/1985 | United Kingdom . |

*Primary Examiner*—Leo P. Picard
*Assistant Examiner*—Stephen T. Ryan
*Attorney, Agent, or Firm*—Harness, Dickey & Pierce, P.L.C.

[57] ABSTRACT

A solenoid has an axially movable plunger having a plunger rod extending from it. The plunger rod has the capability of angular deflection relative to the axial movement of the plunger within the solenoid.

15 Claims, 2 Drawing Sheets

SOLENOID WITH PLUNGER ROD

This is a continuation of U.S. patent application Ser. No. 08/167,738, filed Dec. 15, 1993 is now abandoned.

FIELD OF THE INVENTION

The present invention relates to solenoids. More particularly, the present invention relates to solenoids which have a unique plunger and plunger rod which have the capability of substantial angular movement in addition to the normal axial movement.

BACKGROUND OF THE INVENTION

Solenoids are, of course, well known in the art. A typical design of solenoid has a plunger or movable armature of magnetic material which is slidingly received within a cylindrical guide tube. The guide tube is formed of non-magnetic material and has a stop or a stationary armature of magnetic material located at one end. A biasing member normally urges the plunger or movable armature away from the stop or stationary armature.

A solenoid coil surrounds the cylindrical guide tube and a housing of magnetic material around the solenoid coil comprises, together with the stop and the plunger, a magnetic circuit. When the solenoid coil is de-energized, the plunger is spaced away from the stop by a biasing member. When the solenoid coil is energized by an electric current, the magnetic flux engendered in the magnetic circuit causes the plunger to slide axially in the cylindrical guide tube until it reaches the stop. The axial movement of the plunger is normally extremely rapid and the plunger strikes the stop with considerable force. Upon de-energization of the solenoid coil, the plunger slides away from the stop due to the influence of the biasing member.

Various configurations of plunger rods have been developed which are attached to the plunger in order to transfer the axial movement of the plunger within the housing to an area outside of the housing. The end of the plunger rod within the housing is adapted to mate with the plunger and the end of the plunger rod which extends outside of the housing is adapted to interface with a component which is to be moved axially by the solenoid. In order to effectively move the component in an axial direction, the component which is being moved must be aligned with the longitudinal axis of the solenoid as the movement of the plunger rod of the solenoid will be along the axis of the solenoid. While some misalignment is allowed due to the design and manufacturing tolerance involved in the manufacturing of the various components, it is essential that the axis of the solenoid and component being moved longitudinally be aligned in order to eliminate any type of binding or sticking of the solenoid during its operation.

Accordingly, what is needed is a solenoid which will allow a substantial amount of misalignment between the axis of the solenoid and the axis of the movement of the component being moved by the solenoid in order to provide additional flexibility to the design engineer.

SUMMARY OF THE INVENTION

The present invention provides the art with a solenoid which has an interface between the plunger rod and the plunger which provides for a substantial amount of angulation between the plunger rod and the plunger which moves longitudinally along the axis of the solenoid. In addition, an end cover of the solenoid housing is also configured to allow the angulation of the plunger rod with respect to the plunger and thus the axis of the solenoid.

Other advantages and objects of the present invention will become apparent to those skilled in the art from the subsequent detailed description, appended claims and drawings.

BRIEF DESCRIPTION OF THE DRAWINGS

In the drawings which illustrate the best mode presently contemplated for carrying out the present invention.

DETAILED DESCRIPTION OF THE PREFERRED EMBODIMENT

Figure 1:
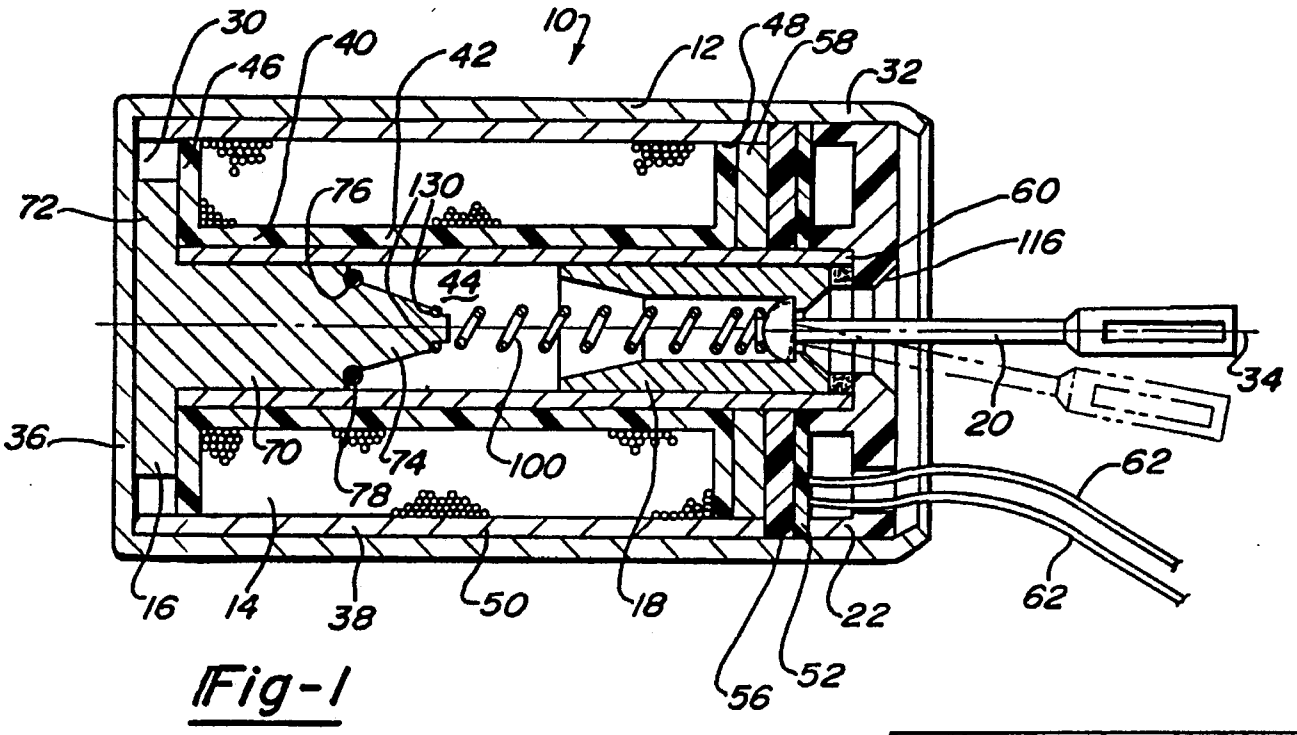
FIG. 1 is a longitudinal cross section of the solenoid of the present invention.

Referring now to the drawings in which like reference numerals designate like or corresponding parts throughout the several views, there is shown in FIG. 1, a solenoid according to the present invention which is designated generally by the reference numeral 10. Solenoid 10 comprises a housing 12, a solenoid coil 14, a south pole stop 16, a north pole plunger 18, a plunger rod 20 and an end cap 22.

Housing 12 is a cup shaped member defining an internal cavity 30 and having an outer cylindrical wall 32 defining a longitudinal axis 34. Cylindrical wall 32 is closed at one end by an end wall 36. A cylindrical sleeve 38 is disposed within housing 12. Sleeve 38 acts as a portion of the conduit for the magnetic circuit developed by solenoid coil 14. Sleeve 38 may be a separate component to housing 12 as shown in FIG. 1, or sleeve 38 may be an integral part of housing 12.

Solenoid coil 14 is disposed within cavity 30 and includes a bobbin 40 which is made from non-magnetic material and has a cylindrical wall 42 defining an internal cavity 44 extending through bobbin 40. Extending radially outward from each end of cylindrical wall 42 is an annular wall 46 and 48. A plurality of coil windings 50 are wrapped around wall 42 between cylindrical walls 46 and 48. The electrical connection to coil windings 50 is made using a printed circuit board 52 which is spaced from annular wall 48 by a plurality of posts (not shown). Disposed between annular wall 48 and circuit board 52 is an insulating washer 56 and a washer 58 made from a magnetic material. Washer 58 also forms a portion of the magnetic circuit developed by solenoid coil 14. A guide tube 60 made of non-magnetic material is disposed within cavity 44 and operates to provide a burr free surface for the movement of plunger 18. A pair of lead wires 62 are soldered to circuit board 52 to facilitate the wiring of solenoid coil 14.

Stop 16 is disposed within cavity 30 at the end of solenoid coil 14 adjacent annular wall 46 of bobbin 40. Stop 16 is made from a magnetic material and includes a cylindrical body 70 having an annular flange 72 at one end and a conical shaped extension 74 at the opposite end. The intersection between cylindrical body 70 and extension 74 is provided with an annular groove 76 for locating an O-ring 78. O-ring 78 cushions the movement of plunger 18 as will be described later herein. Stop 16 is inserted into the open end of guide tube 60 adjacent to annular wall 46 of bobbin 40. Stop 16 also provides a portion of the magnetic circuit developed by solenoid coil 14.

Figure 2:
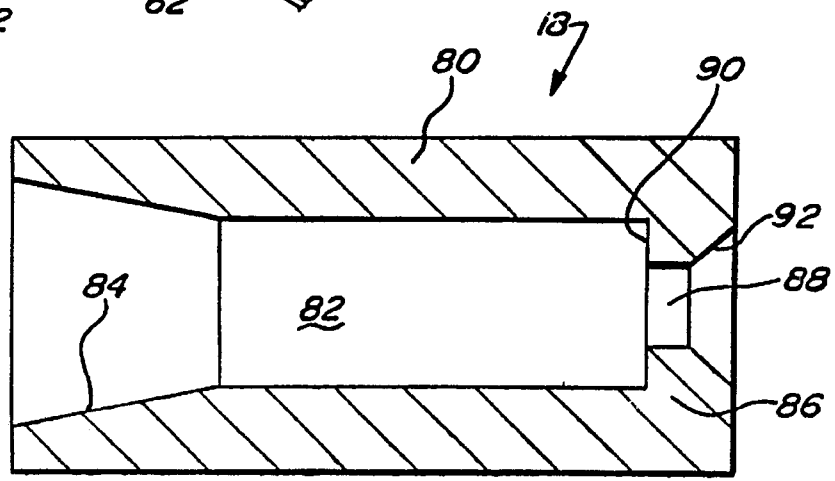
FIG. 2 is an enlarged view of the plunger shown in FIG. 1.

Plunger 18, shown in FIG. 2, is also disposed within cavity 30 and is made from a magnetic material. Plunger 18 has a cylindrical shaped body 80 defining an internal cavity 82. One end of internal cavity 82 forms a chamfer 84 which mates with conical extension 74 during operation of solenoid 10. The outside diameter of cylindrical body 80 is approximately equal to the outer diameter of cylindrical body 70 of stop 16. The end of cylindrical shaped body 80 opposite to chamfer 84 is adapted to mate with plunger rod 20. A flange 86 extends radially inward from internal cavity 82 to define an aperture 88 and a shoulder 90 for retaining plunger rod 20 within cavity 82. Aperture 88 includes a chamfer 92 which provides clearance for plunger rod 20 when plunger rod 20 angulates.

Figure 3:
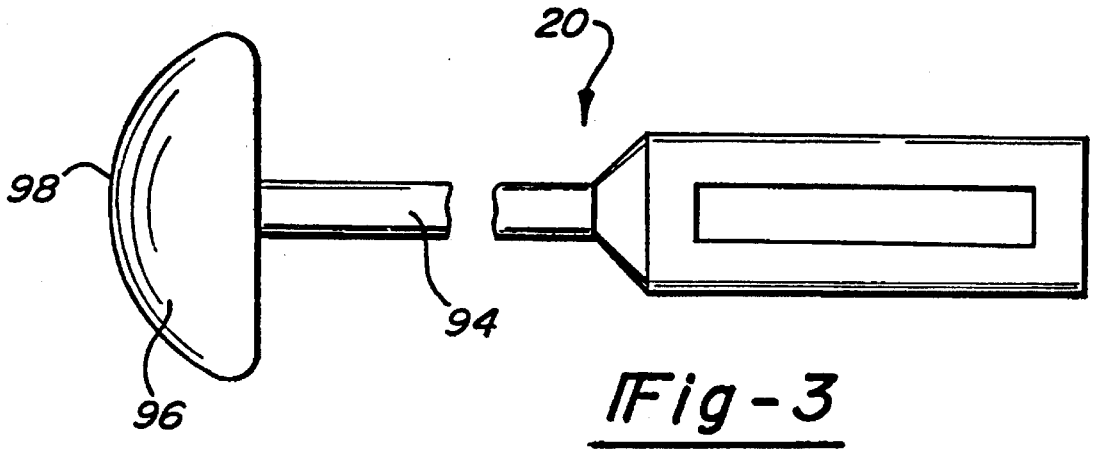
FIG. 3 is an enlarged view of the ends of the plunger rod shown in FIG. 1

Plunger rod 20, shown in FIG. 3, transfers the axial movement of plunger 18 within housing 12 to the outside of housing 12. Plunger rod 20 includes a cylindrical stem 94 having a mushroom shaped spring seat 96 at one end and adapted to mate with the component being moved at the other end. The diameter of stem 94 is approximately one half of the diameter of aperture 88 formed in plunger 18 by flange 86. The difference in diameter allows for the radial clearance required by plunger rod 20 when it angulates relative to plunger 18. Mushroom shaped spring seat 96 has an outside diameter that is slightly less than the inside diameter of cavity 82 of plunger 18. This allows for plunger rod 20 to be slidingly received within cavity 82 while at the same time cooperating with shoulder 90 of flange 86 to retain plunger rod 20 within cavity 82. Spring seat 96 also includes a radiused surface 98 which interfaces with a biasing member or coil spring 100 which is disposed between stop 16 and plunger rod 20 to urge spring seat 96 of plunger rod 20 against shoulder 90 of plunger 18.

Figure 4:
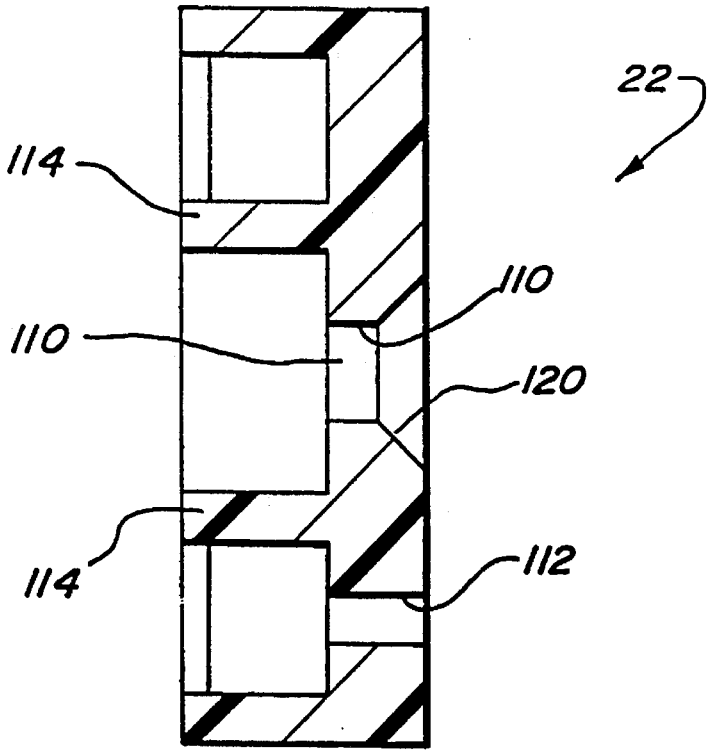
FIG. 4 is an enlarged view of the housing end cap shown in FIG. 1.

End cap 22, as shown in FIG. 4, is a cup shaped member disposed within cavity 30 and made from a non-magnetic material having a centrally located circular aperture 110 and an access aperture 112 located towards the edge of end cap 22. Aperture 110 provides access for plunger rod 20 to extend through end cap 22 while aperture 112 provides access for lead wires 62 to extend through end cap 22. A plurality of ribs 114 extend from the top of end cap 22 into housing 12 to provide for added strength and stability to end cap 22. An annular felt washer 116 is secured to the inside of end cap 22 around aperture 110 to provide for the cushioning of plunger 18 when solenoid coil 14 is deactivated. Aperture 110 includes a cylindrical portion 118 and a conical shaped portion 120. Cylindrical portion 110 and conical shaped portion 120 provide clearance between end cap 22 and plunger rod 20 to allow plunger rod 20 to angulate once solenoid 10 is assembled.

The assembly of solenoid 10 begins with the insertion of guide tube 60 within circuit board 52, washer 56, washer 58 and internal cavity 44 of bobbin 40. Stop 16 is then inserted into guide tube 60 at the end of bobbin 40 adjacent annular wall 46. Coil spring 100 is then inserted into guide tube 60 and positioned on a spring seat 130 located on the end of conical extension 74 of stop 16. Plunger rod 20 is inserted into cavity 82 of plunger 18 with spring seat 96 being located adjacent flange 86 and stem 94 extending axially through aperture 88 formed by flange 86. Plunger 18 is then inserted over coil spring 100 and into guide tube 60 with coil spring 100 resting against radiused surface 98 of spring seat 96 of plunger rod 20. The assembly of solenoid coil 14, stop 16, coil spring 100, plunger 18 and plunger rod 20 is inserted into housing 12. Lead lines 62 are then fed through aperture 112 of end cap 22 and end cap 22 is positioned within housing 12 over bobbin 40 of solenoid coil 14 with lead wires 62 extending through aperture 112 and plunger rod 20 extending through aperture 110. End cap 22 is inserted into housing 12 slightly below the open end of housing 12 and this open end of housing 12 is deformed angularly over end cap 22 to retain the internal components of solenoid 10 within housing 12 as shown in FIG. 1. The insertion of end cap 22 within housing 12 acts to slightly compress coil spring 100 to provide an initial preload on plunger rod 20 to urge plunger rod 20 and plunger 18 into a fully extended position.

The operation of solenoid 10 begins with solenoid 10 being positioned as shown in FIG. 1, without power being supplied to solenoid coil 14. Plunger 18 and plunger rod 20 are urged away from stop 16 into their fully extended positions by coil spring 100. When electrical power is supplied to solenoid 14, a magnetic circuit is developed between stop 16, housing 12, washer 58 and plunger 18. This magnetic circuit creates a south pole at stop 16 and a north pole at plunger 18. Plunger 18 is thus attracted axially towards stop 16 compressing coil spring 100. O-ring 78 cushions the stop of plunger 18 as plunger 18 contacts stop 16. When electrical power to solenoid coil 14 is disconnected, the magnetic circuit is terminated and coil spring 96 again biases plunger 18 and plunger rod 20 into their fully extended positions as shown in FIG. 1. Annular felt washer 116 cushions the stop of plunger 18 as plunger 18 contacts end cap 22.

During the movement of plunger 18 and plunger rod 20 due to the forming of the magnetic circuit, plunger rod 20 is allowed to angulate in relation to longitudinal axis 34 as shown in phantom in FIG. 1. Plunger rod 20 is capable of moving in a conical pattern due to radiused surface 98 on spring seat 96 sliding against the end of coil spring 100, the clearance between stem 94 and aperture 88 in plunger 18, the clearance between stem 94 and chamfer 92 on plunger 18, the clearance between stem 94 and aperture 110 in end cap 22, and the clearance between stem 94 and conical surface 120 on end cap 22. The capability of plunger rod 20 to angulate during its longitudinal movement allows for misalignment of longitudinal axis 34 with the axis of movement of the component being moved by solenoid 10.

While the above detailed description describes the preferred embodiment of the present invention, it should be understood that the present invention is susceptible to modification, variation and alteration without deviating from the scope and fair meaning of the subjoined claims.

What is claimed is:

1. A solenoid comprising:

a housing having a closed rearward wall and a forward wall;

cylindrical guide tube defining a longitudinal axis;

a solenoid coil arranged around said guide tube;

a generally cylindrical plunger having an internal cavity, a forward end including a generally conical forward aperture and a rearward end having a general conical rearward aperture, said plunger disposed within said guide tube and axially slidable therein;

a plunger rod disposed within said internal cavity of said cylindrical plunger, and extending through said aperture;

means for seating said plunger rod, said seating means being positioned within said internal cavity to provide said plunger rod with conical angular movement as well as axial movement in said internal cavity with respect to said longitudinal axis of said guide tube; and a stop adjacent said housing rearward wall having an extension mateable with said plunger rearward aperture.

2. The solenoid according to claim 1 further comprising a biasing member for urging said plunger in a specified direction.

3. The solenoid according to claim 2 wherein said biasing member urges said plunger rod in said specified direction.

4. The solenoid according to claim 1 further comprising a stop disposed at a first end of said guide tube.

5. The solenoid according to claim 4 further comprising a biasing member disposed between said stop and said plunger for urging said plunger away from said stop.

6. The solenoid according to claim 5 wherein said biasing member urges said plunger rod away from said stop.

7. The solenoid according to claim 1 wherein said plunger includes a flange disposed at one end of said plunger, said flange extending radially inward from an interior surface of said plunger, said flange defining a first aperture.

8. The solenoid according to claim 7 wherein said plunger rod includes a stem and a head, said head being axially slidable within said cavity of said plunger, said stem extending through said aperture defined by said flange.

9. The solenoid according to claim 8 further comprising a stop disposed at a first end of said guide tube.

10. The solenoid according to claim 9 further comprising a biasing member disposed between said stop and said plunger rod for urging said plunger rod away from said stop.

11. A solenoid comprising:

a housing defining an internal cavity having a closed end and an open end;

a cylindrical guide tube disposed within said internal cavity and defining a longitudinal axis;

a solenoid coil arranged around said guide tube;

a generally cylindrical plunger having an internal cavity, an open end including an aperture and a closed end including an aperture, said plunger disposed within said guide tube and axially slidable therein;

a plunger rod disposed within said internal cavity of said cylindrical plunger and extending through said plunger aperture;

means for seating said plunger rod, said seating means being positioned within said internal cavity to provide said plunger rod with conical angular movement as well as axial movement in said internal cavity with respect to said longitudinal axis of said guide tube;

a stop disposed at a first end of said guide tube and having an extension mateable with said plunger open and aperture; and an end cap disposed at said open end of said housing, said end cap defining a first aperture, said plunger rod extending through said first aperture in said end cap.

12. The solenoid according to claim 11 further comprising a biasing member for urging said plunger rod away from said stop.

13. The solenoid according to claim 11 wherein said first aperture includes a generally conical surface which provides clearance for said plunger rod when said plunger rod is at an angle relative to said longitudinal axis.

14. The solenoid according to claim 11 wherein said plunger includes a flange disposed at one end of said plunger, said flange extending radially inward from an interior surface of said plunger, said flange defining a second aperture, said plunger rod extending through said second aperture.

15. The solenoid according to claim 14 wherein said second aperture includes a generally conical surface which provides clearance for said plunger rod when said plunger rod is at an angle with respect to said longitudinal axis.

* * * * *

UNITED STATES PATENT AND TRADEMARK OFFICE

CERTIFICATE OF CORRECTION

PATENT NO. : 5,546,064

DATED : August 13, 1996

INVENTOR(S) : Faisal K. Sallam et al

It is certified that error appears in the above-indentified patent and that said Letters Patent is hereby corrected as shown below:

Item [63], Title Page, Related U.S. Application Data, "Dec. 19, 1993" should be --Dec. 15, 1993--

Column 4, line 53, claim 1, insert --a-- before "cylindrical"

Column 4, line 57, claim 1, "general" should be --generally--

Column 4, line 61, claim 1, insert --plunger forward-- after "said"

Column 5, line 17, claim 7, delete "one" and insert --said forward--

Column 5, line 19, claim 7, "a first" should be --said plunger forward--

Column 5, line 23, claim 8, insert --plunger forward-- after "said"

Column 6, line 5, claim 11, insert --closed end-- before "aperture"

Column 6, line 12, claim 11, "and" should be --end--

Column 6, line 27, claim 14, "one" should be --said closed--

Column 6, line 29, claim 14, "a second" should be --said plunger closed end--

Column 6, line 30, claim 14, "second" should be --plunger closed end--

UNITED STATES PATENT AND TRADEMARK OFFICE

CERTIFICATE OF CORRECTION

PATENT NO. : 5,546,064

DATED : August 13, 1996

INVENTOR(S) : Faisal K. Sallam, et. al.

It is certified that error appears in the above-indentified patent and that said Letters Patent is hereby corrected as shown below:

Column 6, line 33, claim 15, "second" should be --plunger closed end--.

Signed and Sealed this

Eleventh Day of February, 1997

Bruce Lehman

*Attest:*

BRUCE LEHMAN

*Attesting Officer*

*Commissioner of Patents and Trademarks*